US010400532B2

(12) United States Patent
Holly et al.

(10) Patent No.: US 10,400,532 B2
(45) Date of Patent: Sep. 3, 2019

(54) DOWNHOLE TOOL ANCHORING DEVICE

(71) Applicant: HALLIBURTON ENERGY SERVICES, INC., Houston, TX (US)

(72) Inventors: Mark S Holly, Singapore (SG); Wei Zhang, Plano, TX (US); Jack Clemens, Fairview, TX (US); Nikhil Manmadhan Kartha, Singapore (SG); Josh Lim, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 84 days.

(21) Appl. No.: 15/324,556

(22) PCT Filed: Jul. 29, 2014

(86) PCT No.: PCT/US2014/048721
§ 371 (c)(1),
(2) Date: Jan. 6, 2017

(87) PCT Pub. No.: WO2016/018268
PCT Pub. Date: Feb. 4, 2016

(65) Prior Publication Data

US 2017/0204692 A1 Jul. 20, 2017

(51) Int. Cl.
*E21B 23/01* (2006.01)
*E21B 47/00* (2012.01)

(52) U.S. Cl.
CPC ..... *E21B 23/01* (2013.01); *E21B 47/00* (2013.01)

(58) Field of Classification Search
CPC . E21B 47/00; E21B 23/01; E21B 4/18; E21B 17/10
See application file for complete search history.

(56) References Cited

U.S. PATENT DOCUMENTS

| | | | |
|---|---|---|---|
| 5,086,645 | A | 2/1992 | Deaton |
| 6,464,003 | B2 | 10/2002 | Bloom et al. |
| 6,968,904 | B2 | 11/2005 | Bakke |
| 7,278,482 | B2 | 10/2007 | Azar |
| 7,690,423 | B2 | 4/2010 | Del Campo et al. |

(Continued)

FOREIGN PATENT DOCUMENTS

| | | |
|---|---|---|
| EP | 0964131 | 12/1999 |

OTHER PUBLICATIONS

PCT International Search Report and Written Opinion, dated Apr. 23, 2015, Appl No. PCT/US2014/048721,"Downhole Tool Anchoring Device," Filed Jul. 29, 2014, 16 pgs.

(Continued)

*Primary Examiner* — David J Bagnell
*Assistant Examiner* — Manuel C Portocarrero
(74) *Attorney, Agent, or Firm* — Alan Bryson; C. Tumey Law Group PLLC

(57) ABSTRACT

A downhole tool includes a tool body and a first anchoring device integrated with the tool body. The first anchoring device includes at least two linear actuators within and non-perpendicular to the tool body, each of the at least two linear actuators configured to move a corresponding contact pad between a retracted position and an anchor position. The first anchoring device also includes at least one guide component coupled to each contact pad to restrict movement of a corresponding contact pad to a predetermined path.

18 Claims, 4 Drawing Sheets

(56) References Cited

U.S. PATENT DOCUMENTS

| | | | | |
|---|---|---|---|---|
| 7,886,834 | B2 | 2/2011 | Spencer et al. | |
| 8,136,588 | B2 | 3/2012 | Manson | |
| 2003/0168222 | A1* | 9/2003 | Maguire | E21B 43/103 166/380 |
| 2009/0159269 | A1 | 6/2009 | Sheiretov et al. | |
| 2010/0258293 | A1 | 10/2010 | Lynde et al. | |
| 2011/0146970 | A1 | 6/2011 | Hallundbaek et al. | |
| 2012/0061074 | A1 | 3/2012 | Bloom et al. | |
| 2013/0025885 | A1 | 1/2013 | Mineo et al. | |
| 2013/0206392 | A1 | 8/2013 | Sherman | |
| 2014/0014315 | A1 | 1/2014 | Hallundbaek | |

OTHER PUBLICATIONS

PCT International Preliminary Report on Patentability, dated Nov. 24, 2015, Appl No. PCT/US2014/048721,"Downhole Tool Anchoring Device," Filed Jul. 29, 2014, 14 pgs.

* cited by examiner

DOWNHOLE TOOL ANCHORING DEVICE

BACKGROUND

Oil and gas exploration and production generally involve drilling boreholes, where at least some of the boreholes are converted into permanent well installations such as production wells, injections wells, or monitoring wells. Before or after a borehole has been converted into a permanent well installation, the borehole or casing may be modified to update its purpose and/or to improve its performance. Such borehole or casing modifications are sometimes referred to as well interventions. Some examples of well interventions involve using a coiled tubing or wireline to deploy one or more tools for matrix and fracture stimulation, wellbore cleanout, logging, perforating, completion, casing, workover, production intervention, nitrogen kickoff, sand control, drilling, cementing, well circulation, fishing services, sidetrack services, mechanical isolation, and/or plugging.

Sometimes the tool performing a well intervention needs to be anchored against a borehole wall or a tubular (e.g., a casing). Existing anchor designs may suffer from one or more of the following shortcomings: a limited reach, insufficient anchoring force or grip, misaligned anchor points, a large profile, lack of durability, and power loss/sticking issues.

BRIEF DESCRIPTION OF THE DRAWINGS

Accordingly, there are disclosed in the drawings and the following description a downhole tool anchoring device intended to address the at least some of the above-mentioned shortcomings. In the drawings.

Figure 1:
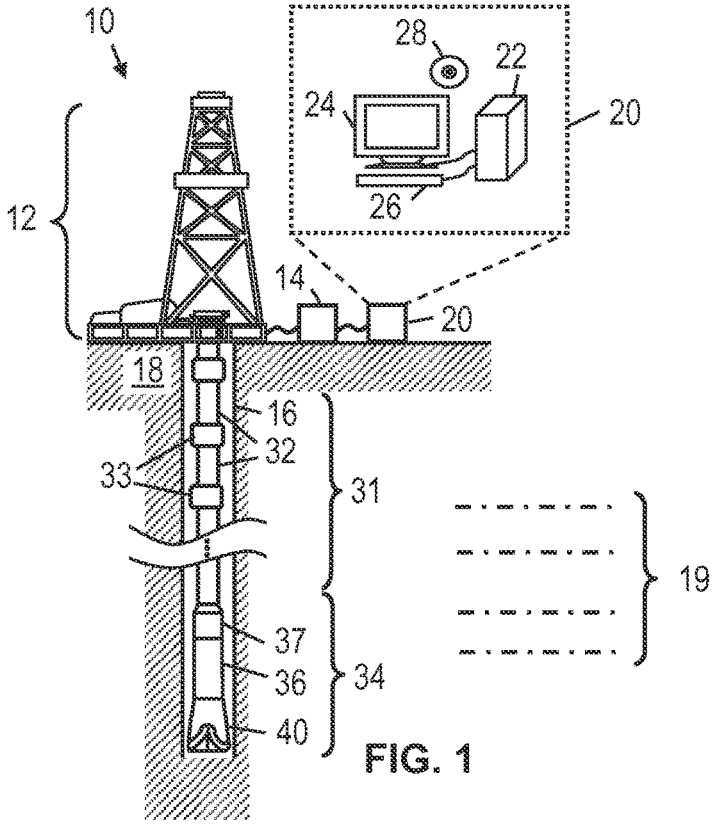
FIG. 1 is schematic diagram showing a drilling environment.

It should be understood, however, that the specific embodiments given in the drawings and detailed description do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Disclosed herein are various anchoring device designs, which use linear actuator orientations that are non-perpendicular and non-parallel to a tool body. The use of a non-perpendicular and non-parallel orientation for each linear actuator of an anchoring device facilitates integrating anchoring device components with a tool body while supporting a suitable anchoring reach. In a retracted position, the anchoring device components preferably fit within or are flush with an outer profile of the tool body. In an extended position, one or more contact pads associated with the anchoring device extend beyond the outer profile of the tool body and contact a nearby surface (e.g., a borehole wall or tubular).

As an example, a downhole tool may comprise a tool body and an anchoring device integrated with the tool body such that components of the anchoring device are within or are flush with an outer profile of the tool body when retracted. The anchoring device may comprise at least two linear actuators within and non-perpendicular to the tool body, where each of the at least two linear actuators are configured to move a corresponding contact pad between a retracted position and an anchor position. For example, each contact pad may correspond to a swivel head or other component that is able to adjust its orientation to increase the amount of contact with a surface when extended. Further, each linear actuator corresponds to a hydraulic or electromechanical device (e.g., a motor-based actuator) with a movable element. To direct the movable element forward (e.g., to extend a contact pad), the linear actuator applies a force with at least some forward component to the moveable element. Meanwhile, to direct the moveable element backwards (e.g., to retract a contact pad), the linear actuator applies a force with at least some backwards component to the moveable element. In some embodiments, the moveable element couples to a retraction spring or other mechanism that automatically retracts the moveable element when the linear actuator is not applying a forward force and/or when a position release mechanism is triggered.

The non-parallel and non-perpendicular orientation of each linear actuator relative to a tool body is such that the forward direction for each moveable element includes an outward component relative to the tool body. The particular orientation of each linear actuator relative to a tool body may be selected to comply with packaging restrictions as well as the number of linear actuators used for each anchoring device.

In accordance with at least some embodiments, the anchoring device also comprises at least one guide component coupled to each contact pad to restrict movement of a corresponding contact pad to a predetermined path. In at least some embodiments, each guide component may correspond to a beam spring or bow spring. In addition to restricting movement of a corresponding contact pad, guide components may cause a contact pad to retract in response to failure or power loss of a linear actuator.

The disclosed anchoring device designs may be used with various types of downhole tools. In particular, downhole tools configured to perform well intervention operations may employ the disclosed anchoring device. For example, an anchored downhole tool may perform one or more well intervention operations including, but not limited to, matrix and fracture stimulation, wellbore cleanout, logging, perforating, completion, casing, production intervention, workover, nitrogen kickoff, sand control, drilling, cementing, well circulation, fishing services, sidetrack services, mechanical isolation, and/or plugging. Depending on the downhole operations to be performed, the anchoring specifications for each downhole tool (e.g., the number of anchoring devices used, the orientation and position of each anchoring device along a tool body, the number of linear actuators for each anchoring device, the amount of force to be applied by each linear actuator) may be adjusted. The anchoring specifications may also be adjusted depending on the size of tool body relative to a borehole or tubular size.

The disclosed anchoring device designs are best understood when described in an illustrative usage context. FIG. 1 shows an illustrative drilling environment 10, where a drilling assembly 12 enables a drill string 31 to be lowered and raised in a borehole 16 that penetrates formations 19 of the earth 18. The drill string 31 is formed, for example, from a modular set of drill pipe sections 32 and adaptors 33. At the lower end of the drill string 32, a bottomhole assembly 34 with a drill bit 40 removes material from the formation 18 using known drilling techniques. The bottomhole assembly 34 also includes one or more drill collars 37 and may include a logging tool 36 to optically measure-while-drilling (MWD) and/or logging-while-drilling (LWD) measurements.

In FIG. 1, an interface 14 at earth's surface receives the MWD and/or LWD measurements via mud based telemetry or other wireless communication techniques (e.g., electromagnetic, acoustic). Additionally or alternatively, a cable including electrical conductors and/or optical waveguides (e.g., fibers) may be used to enable transfer of power and/or communications between the bottomhole assembly 34 and earth's surface. The cable 15 may be integrated with, attached to, or inside components of the drill string 31 (e.g., IntelliPipe sections may be used).

The interface 14 may perform various operations such as converting signals from one format to another, filtering, demodulation, digitization, and/or other operations. Further, the interface 14 conveys the MWD and/or LWD measurements or related data to a computer system 20 for storage, visualization, and/or analysis. In at least some embodiments, the computer system 20 includes a processing unit 22 that enables visualization and/or analysis of MWD and/or LWD measurements by executing software or instructions obtained from a local or remote non-transitory computer-readable medium 28. The computer system 20 also may include input device(s) 26 (e.g., a keyboard, mouse, touchpad, etc.) and output device(s) 24 (e.g., a monitor, printer, etc.). Such input device(s) 26 and/or output device(s) 24 provide a user interface that enables an operator to interact with the logging tool 36 and/or software executed by the processing unit 22. For example, the computer system 20 may enable an operator to select visualization and analysis options, to adjust drilling options, and/or to perform other tasks. Further, the MWD and/or LWD measurements collected during drilling operations may facilitate determining the location of subsequent well intervention operations and/or other downhole operations, where the downhole tool is anchored as described herein.

Figure 2A:
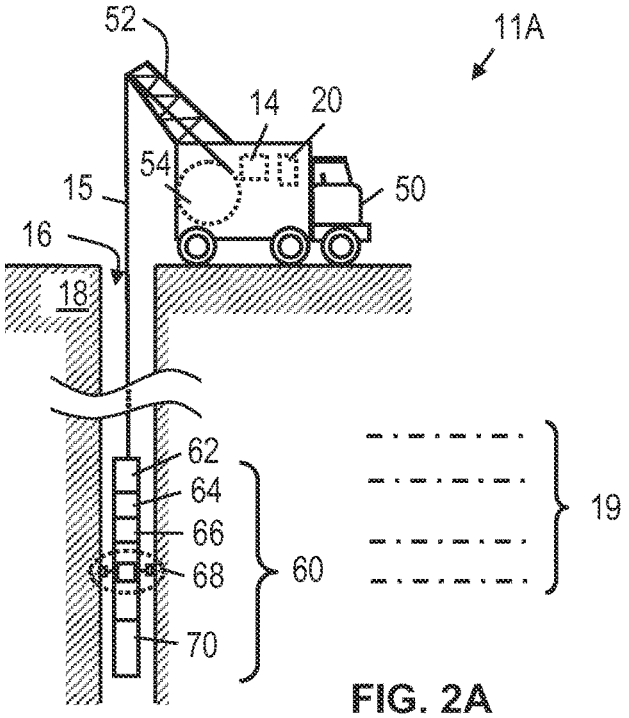
FIGS. 2A and 2B are schematic diagrams showing wireline tool string environments.

At various times during the drilling process, the drill string 31 shown in FIG. 1 may be removed from the borehole 16. With the drill string 32 removed, wireline logging and/or well intervention operations may be performed as shown in the wireline tool string environment 11A of FIG. 2A (an "openhole" scenario). In environment 11A, a wireline tool string 60 is suspended in borehole 16 that penetrates formations 19 of the earth 18. For example, the wireline tool string 60 may be suspended by a cable 15 having electrical conductors and/or optical fibers for conveying power to the wireline tool string 60. The cable 15 may also be used as a communication interface for uphole and/or downhole communications. In at least some embodiments, the cable 15 wraps and unwraps as needed around cable reel 54 when lowering or raising the wireline tool string 60. As shown, the cable reel 54 may be part of a movable logging facility or vehicle 50 having a cable guide 52.

In at least some embodiments, the wireline tool string 60 includes various sections including power section 62, control/electronics section 64, actuator section 66, anchor section 68, and intervention tool section 70. The anchor section 68, for example, includes one or more anchor devices as described herein to contact the wall of borehole 16, thereby maintaining the wireline tool string 60 in a fixed position during intervention tool operations and/or other operations. While not required, the wireline tool string 60 also may include one or more logging tool sections to collect sensor-based logs as a function of tool depth, tool orientation, etc.

At earth's surface, an interface 14 receives sensor-based measurements and/or communications from wireline tool string 60 via the cable 15, and conveys the sensor-based measurements and/or communications to computer system 20. The interface 14 and/or computer system 20 (e.g., part of the movable logging facility or vehicle 50) may perform various operations such as data visualization and analysis, anchoring device control, intervention tool monitoring and control, and/or other operations.

Figure 2B:
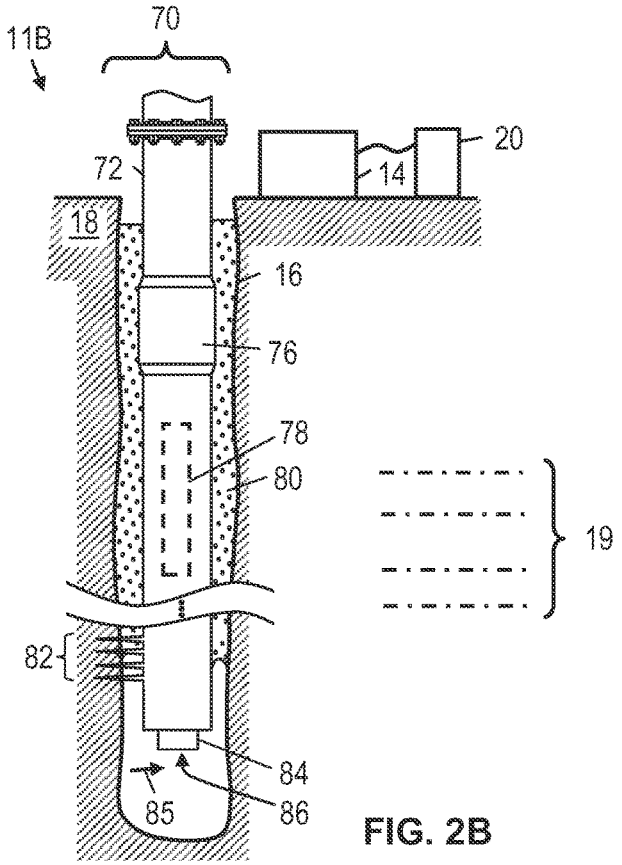

FIG. 2B shows another wireline tool string environment 11B (a "completed well" or at partially completed well scenario). In environment 11B, a drilling rig has been used to drill borehole 16 that penetrates formations 19 of the earth 18 in a typical manner (see e.g., FIG. 1A). Further, a casing string 72 is positioned in the borehole 16. The casing string 72 of well 70 includes multiple tubular casing sections (usually about 30 feet long) connected end-to-end by couplings 76. It should be noted that FIG. 2B is not to scale, and that casing string 72 typically includes many such couplings 76. Further, the well 70 includes cement slurry 80 that has been injected into the annular space between the outer surface of the casing string 72 and the inner surface of the borehole 16 and allowed to set. Further, a production tubing string 84 has been positioned in an inner bore of the casing string 72.

In at least some embodiments, the purpose of the well 70 is to guide a desired fluid (e.g., oil or gas) from a section of the borehole 16 to a surface of the earth 18. In such case, perforations 82 may be formed at a section of the borehole 16 to facilitate the flow of a fluid 85 from a surrounding formation into the borehole 16 and thence to earth's surface via an opening 86 at the bottom of the production tubing string 84. Note that this well configuration is illustrative and not limiting on the scope of the disclosure. Other permanent well configurations may be configured as injection wells or monitoring wells.

In environment 11B, a wireline tool string 78 may be deployed inside casing string 72 (e.g., before the production tubing string 84 has been positioned in an inner bore of the casing string 72) and/or production tubing string 84. In accordance with at least some embodiments, the wireline tool string 78 has sections similar to those described for wireline tool string 60, but may have a different outer diameter to facilitate deployment in a tubular rather than an openhole scenario. In particular, the wireline tool string 78 includes one or more anchoring devices as described herein to contact the wall of casing string 72 or production tubing string 84, thereby maintaining the wireline tool string 78 in a fixed position during intervention tool operations and/or other operations. While not required, the wireline tool string 78 may include one or more logging tool sections to collect sensor-based logs as a function of tool depth, tool orientation, etc.

At earth's surface, a surface interface 14 receives sensor-based measurements and/or communications from wireline tool string 78 via a cable (e.g., cable 15) or other telemetry, and conveys the sensor-based measurements and/or communications to computer system 20. The surface interface 14 and/or computer system 20 may perform various operations such as data visualization and analysis, anchoring device control, intervention tool monitoring and control, and/or other operations. While FIGS. 2A and 2B describe deployment of downhole tools using a wireline, it should be appreciated that coiled tubing is another option for such deployment.

Figure 3A:
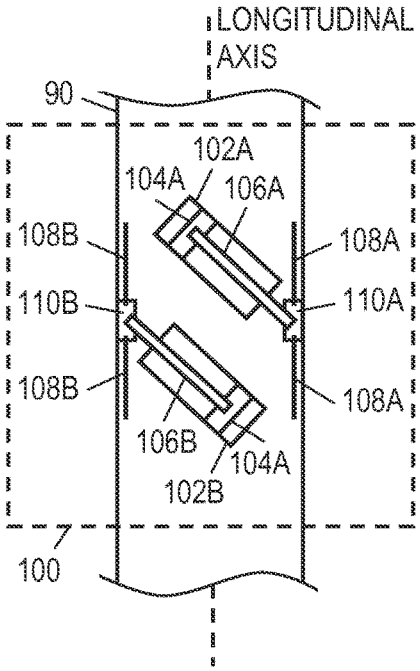
FIG. 3A is a cross-sectional view showing part of a downhole tool with an anchoring device in a retracted position.
Figure 3B:
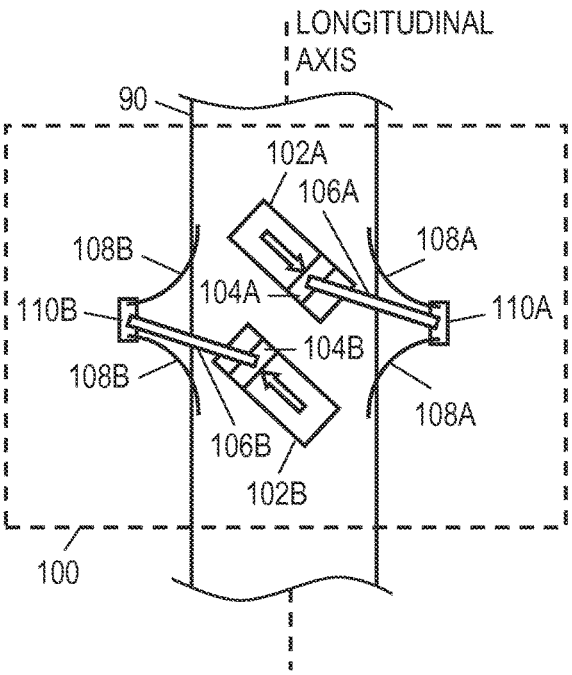
FIG. 3B is a cross-sectional view showing part of the downhole tool of FIG. 3A with the anchoring device in an extended position.

FIGS. 3A and 3B show part of a downhole tool (e.g., tool 60 or 78) with an anchoring device 100. The anchoring device 100 may, for example, be part of the anchor section 66 mentioned for wireline tool string 60. More specifically, FIG. 3A shows the anchoring device 100 in a retracted position, while FIG. 3B shows the anchoring device 100 in an extended position. While not required, all of the components of the anchoring device 100 preferably fit within and/or are flush with the outer profile of tool body 90 when the anchoring device 100 is in its retracted position as in FIG. 3A.

The disclosed anchoring device embodiments comprise a set of anchor units 101 (see FIG. 3C) having orientations that are non-perpendicular and non-parallel to the tool body 90. In the embodiment of FIGS. 3A and 3B, the anchoring device 100 includes two anchor units 101, where each anchor unit 101 corresponds to a linear actuator and related components (see FIG. 3C). However, it should be appreciated that more than two of such anchor units 101 could be used by the anchoring device 100 (e.g., a set with 3 or 4 anchor units 101 may be used). Regardless of the number of anchor units 101 used, the orientation of the anchor units 101 may vary. For example, when two anchor units 101 are used as in the embodiment of FIGS. 3A and 3B, their orientations may be offset from each other by 180 degrees. Further, the axial position of anchor units 101 along a downhole tool related to tool body 90 may be offset. Such orientation and axial offsets enable the anchors units 101 to be packaged compactly within tool body 90 while still enabling a desired reach and balanced anchoring when the anchoring device 100 is in an extended position to contact a borehole wall or tubular at two or more contact points. In at least some embodiments, the balanced anchoring provided by the anchoring device 100 does not significantly alter the orientation of the downhole tool. Thus, in at least some embodiments, if a threshold clearance between the tool body and a borehole wall or tubular exists while the anchoring device 100 is in its retracted position, the balanced anchoring provided by the anchoring device 100 maintains the threshold clearance when the anchoring device 100 is in its extended position. In other words, the anchoring device 100, when in its extended position, avoids causing tool tilting and/or pressure points along the tool body 90 due to contact of the tool body 90 with the borehole wall or tubular during anchoring).

While balanced anchoring is useful for many downhole operations, it should be appreciated that there may be circumstances where extending a single anchoring unit 101 to cause an off-center orientation for a downhole tool in a borehole or tubular is desired. Accordingly, in some embodiments, a downhole tool may employ an anchoring device having a single anchor unit 101. Alternatively, for anchoring devices with multiple anchor units (e.g., anchoring device 100), only one of the anchor units 101 would be extended in such circumstances. The off-center orientation may helpful, for example, for collecting sensor-based data and/or for adjusting the position of a particular tool relative to a borehole wall or tubular.

Figure 3C:
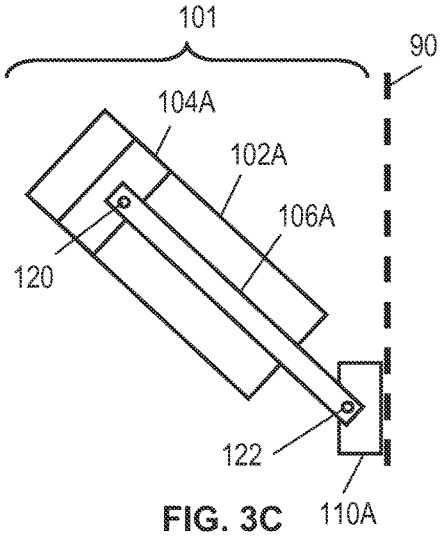
FIG. 3C is a close-up view showing an anchor unit for the anchoring device of FIG. 3A in a retracted position.

As shown best in FIG. 3C, each anchor unit is associated with a linear actuator, a moving component (e.g., a piston), a shaft, and a contact pad. More specifically, the linear actuator 102A is associated with moving component 104A, shaft 106A, and contact pad 110A. Similarly, the linear actuator 102B is associated with moving component 104B, shaft 106B, and contact pad 110B. Further, each contact pad may be associated with two or more guide components (e.g., beam springs or bow springs) to restrict movement of the corresponding contact pad to a predetermined path (best seen in FIGS. 3A and 3B). The guide components may also function to assist with retraction of the contact pad 110A once anchoring is no longer desired or if the event the corresponding downhole tool loses power.

For example, contact pad 110A has two guide components 108A to guide its movement, while contact pad 110B has two guide components 108B to guide its movement. (3 or 4 guide components are also possible and would further restrict contact pad movement to a predetermined path as well as assist with contact pad retraction.) When linear actuator 102A causes moving component 104A to move forward, the shaft 106A pushes the contact pad 110A outward along a predetermined path corresponding to the flexure arrangement of the guide components 108A. While variations are possible, the intended predetermined path enabled by the flexure arrangement of the guide components 108A enables the contact pad 110A to move radially with little or no axial movement (i.e., the predetermined path extends perpendicular to the tool body 90). Similarly, when linear actuator 102B causes moving component 104B to move forward, the shaft 106B pushes the contact pad 110B outward along a predetermined path corresponding to the flexure arrangement of the guide components 108B. Again, the intended predetermined path enabled by the flexure arrangement of the guide components 108B enables the contact pad 110B to move radially with little or no axial movement. FIG. 3B shows the result of operating the linear actuators 102A and 102B together so that the anchoring device 100 is in an extended position. In the extended position, the contact pads 110A and 110B are intended to contact a borehole wall or tubular with sufficient force to enable well intervention operations by a downhole tool (e.g., tool 60 or 78) corresponding to tool body 90.

In FIG. 3C, anchor unit 101 is shown in its retracted position, where all components of the anchor unit 101 (linear actuator 102A, moving components 104A, shaft 106A, contact pad 110A) fit within and/or are flush with the outer profile of tool body 90. The guide components (shown in FIGS. 3A and 3B, but not in FIGS. 3C and 3D) may also be considered part of each anchor unit 101, and preferably fit within and/or are flush with the outer profile of tool body 90 when anchor unit 101 is in its retracted position.

In at least some embodiments, the linear actuator 102 of an anchor unit 101 corresponds to a hydraulic actuator. In such case, the downhole tool corresponding to tool body 90 may include hydraulic fluid lines, a hydraulic power sources, seals, or other components (e.g., in the power section 62, control/electronics section 64, and actuator section 66 of the corresponding downhole tool). Alternatively, the linear actuator 102 of an anchor unit may correspond to an electro-mechanical actuator that converts rotation of a motor to a linear displacement. In such case, the downhole tool corresponding to tool body 90 may include electrical lines, motor control circuitry, and related components (e.g., in the power section 62, control/electronics section 64, and actuator section 66 of the corresponding downhole tool).

Figure 3D:
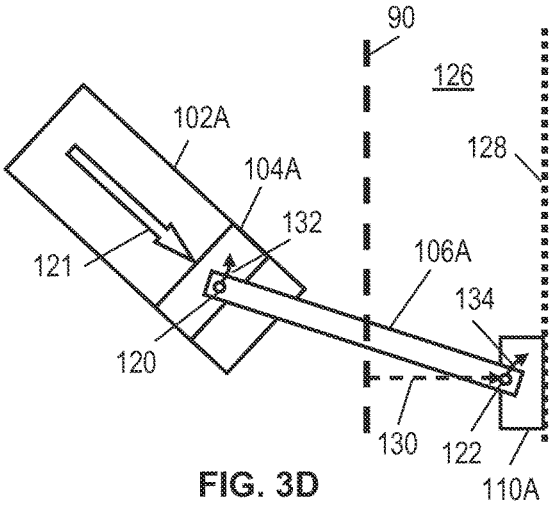
FIG. 3D is a close-up view showing an anchor unit for the anchoring device of FIG. 3A in an extended position.

In FIG. 3D, anchor unit 101 is shown in its extended position due to the moving component 104A of the linear actuator 102A being directed forward by an amount represented by arrow 121. As a result, the shaft 106A and contact pad 110A move outward beyond the outer profile of the tool body 90 along predetermined path 130. The length of the predetermined path 130 corresponds to the radial component of movement arrow 121, which may vary in length depending on the anchoring scenario (e.g., the amount of reach needed and/or the number of anchor units to be used). In the example of FIG. 3D, the contact pad 110A passes through clearance space 126 to contact surface 128, which may correspond to a borehole wall or tubular. With the anchor unit 101 in its extended position, the angle between contact pad 110A and the shaft 106A changes as represented by arrow 134 depending on the alignment of the tool body 90 and the surface 128. For example, the rotatable coupling between contact pad 110A and shaft 106A may correspond to a pin 122 that extends through at least part of contact pad 110A and shaft 106A. The angle between the shaft 106A and the moving component 104A may also change as represented by arrow 132. The rotatable coupling between the shaft 106A and moving component 104A may correspond to a pin 120 that extends through at least part of moving component 104A and shaft 106A.

Figure 4A:
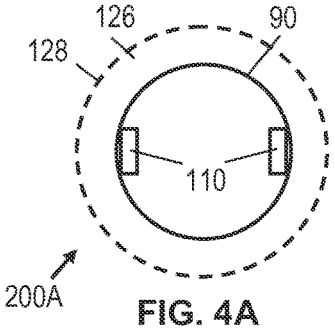
FIGS. 4A-4F are simplified views showing illustrative anchoring device configurations.
Figure 4C:
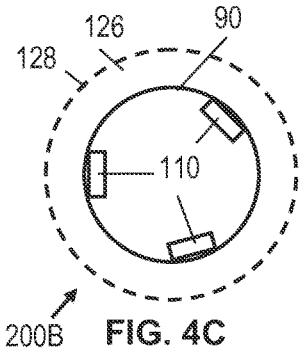
Figure 4E:
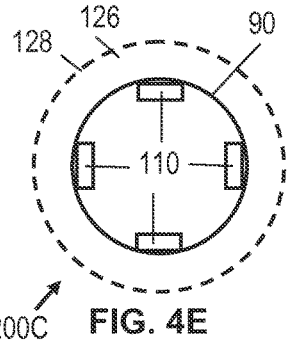
Figure 4B:
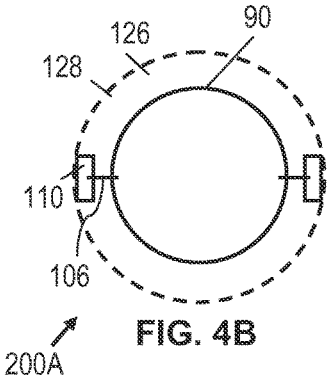

FIGS. 4A-4F show various anchoring device configurations 200A-200C. More specifically, the configuration 200A of FIGS. 4A and 4B represents a downhole tool with an anchoring device having two anchor units, where a refracted position is represented in FIG. 4A and an extended position is represented in FIG. 4B. In FIG. 4A, the two contact pads 110 are positioned interior to and on opposite sides (at an offset of 180 degrees for each other) of the tool body 90. When the anchoring units associated with contact pads 110 are in an extended position as in FIG. 4B, the contact pads 110 (and shafts 106) extend into clearance space 126 to contact surface 128, anchoring the downhole tool corresponding to tool body 90.

Figure 4D:
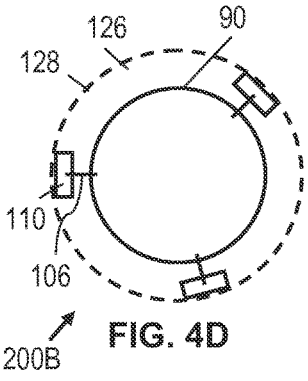

Meanwhile, the configuration 200B of FIGS. 4C and 4D represents a downhole tool with an anchoring device having two anchor units, where a retracted position is represented in FIG. 4C and an extended position is represented in FIG. 4D. In FIG. 4C, the three contact pads 110 are positioned interior to and on respective sides (at an offset of 120 degrees from each other) of the tool body 90. When the anchoring units associated with contact pads 110 are in an extended position as in FIG. 4D, the contact pads 110 (and shafts 106) extend into clearance space 126 to contact surface 128, anchoring the downhole tool corresponding to tool body 90.

Figure 4F:
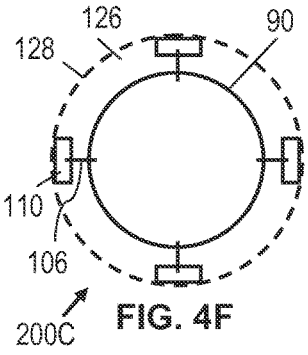

The configuration 200C of FIGS. 4E and 4F represents a downhole tool with an anchoring device having four anchor units, where a retracted position is represented in FIG. 4E and an extended position is represented in FIG. 4F. In FIG. 4E, the four contact pads 110 are positioned interior to and on respective sides (at an offset of 90 degrees from each other) of the tool body 90. When the anchoring units associated with contact pads 110 are in an extended position as in FIG. 4F, the contact pads 110 (and shafts 106) extend into clearance space 126 to contact surface 128, anchoring the downhole tool corresponding to tool body 90.

While FIGS. 4A-4F shows the contact pads 110 retracted together or extended together, it should be appreciated that individual contact pads 110 can be retracted or extended as needed. Further, each of the configurations 200A-200C of FIGS. 4A-4F represents only one "layer" of anchor units. In practice, a downhole tool (e.g., tool 60 or 78) may have multiple layers of anchor units. For example, multiple anchoring devices, each having multiple anchor units may be positioned along a downhole tool. The number of anchor units for each layer may vary as noted herein. Further, the orientation of anchor units for each layer may vary such that the contact point options vary with respect to azimuth (increasing stability of the anchor and providing selectable anchor options).

Figure 5:
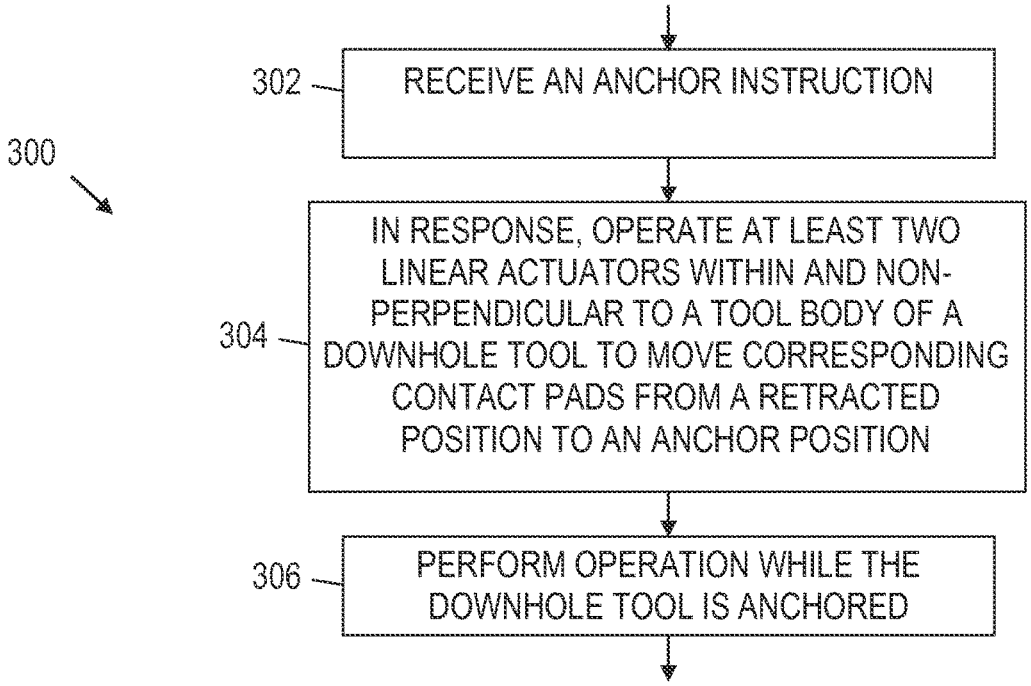
FIG. 5 is a flowchart showing a well intervention method.

FIG. 5 shows a well intervention method 300. The method 300 may be performed, for example, by a downhole tool (e.g., part of wireline tool string 60 or 78). At block 302, an anchor instruction is received. The anchor instruction may be received (e.g., by wireline tool string 60 or 78) from a surface computer (e.g., computer 70) with programming and/or an operator that selects when the downhole tool is to be anchored. Additionally or alternatively, the downhole tool may receive the anchor instruction from an embedded processing system (e.g., part of control/electronics section 64 of wireline tool string 60) that determines when the downhole tool is to be anchored using sensor-based data collected downhole. At block 304, at least two linear actuators operate to move corresponding contact pads from a retracted position to an anchor position in response to the anchor instruction, where the at least two linear actuators are within and non-perpendicular to a tool body of the downhole tool. At block 306, an operation is performed while the downhole tool is anchored. Example operations include, but are not limited to, setting or removing a plug (e.g., for hydraulic fracturing operations), shifting a sleeve (e.g., a filter or screening sleeve), and cutting or milling a damaged tubular.

Embodiments disclosed herein include:

A: A downhole tool that comprises a tool body and a first anchoring device integrated with the tool body. The first anchoring device comprises at least two linear actuators within and non-perpendicular to the tool body, each of the at least two linear actuators configured to move a corresponding contact pad between a refracted position and an anchor position. The first anchoring device also comprises at least one guide component coupled to each contact pad to restrict movement of a corresponding contact pad to a predetermined path.

B: A method that comprises receiving, by a tool deployed in a downhole environment, an anchor instruction. The method also comprises, in response to receiving the anchor instruction, operating at least two linear actuators within and non-perpendicular to a tool body of the tool to move corresponding contact pads from a retracted position to an anchor position. The method also comprises performing an operation while the tool is anchored.

Each of the embodiments, A and B, may have one or more of the following additional elements in any combination. Element 1: the first anchoring device further comprises a shaft coupling each linear actuator with each corresponding contact pad. Element 2: each shaft is rotatably-coupled at opposite ends to a corresponding linear actuator and contact pad. Element 3: the at least one guide component comprises at least two bow springs. Element 4: the at least one guide component is configured to assist with retraction of a contact pad from its anchor position even if the downhole tool loses power. Element 5: the at least two linear actuators comprise two linear actuators having opposite orientations that are non-perpendicular to the tool body. Element 6: each predetermined path corresponds to a path that is approximately perpendicular to the tool body. Element 7: the first anchoring device fits within an outer profile of the tool body when the contact pads are in their retracted position. Element 8: each contact pad is at approximately the same longitudinal position along the tool body when in the retracted position and the anchor position. Element 9: the linear actuator comprises a hydraulic piston. Element 10: further comprising a well intervention component that is activated after the first anchoring device anchors the tool against a borehole wall or tubular. Element 11: further comprising at least one additional anchoring device to anchor the tool at different longitudinal and azimuthal positions against a borehole wall or tubular.

Element 12: further comprising restricting movement of each contact pad to a predetermined path. Element 13: restricting movement of each contact pad is performed by at least two bow springs. Element 14: each predetermined path corresponds to a path that is approximately perpendicular to the tool body. Element 15: further comprising rotatably-coupling a shaft at opposite ends to a corresponding linear actuator and contact pad. Element 16: further comprising arranging the at least two linear actuators as two linear actuators having opposite orientations that are non-perpendicular to the tool body. Element 17: further comprising deploying the tool in the downhole environment using a wireline or coiled tubing. Element 18: performing an operation while the tool is anchored comprises performing a well intervention operation.

Numerous variations and modifications will become apparent to those skilled in the art once the above disclosure is fully appreciated. It is intended that the following claims be interpreted to embrace all such variations and modifications.

What is claimed is:

1. A downhole tool that comprises:

a tool body; and a first anchoring device integrated with the tool body, wherein the first anchoring device comprises:

at least two linear actuators fully within and non-perpendicular to the tool body, each of the at least two linear actuators configured to move a corresponding contact pad between a retracted position and an anchor position, and each of the two linear actuators includes a moving component that is movable within each of the two linear actuators and the moving component is connected to a shaft at a first end of the shaft and the shaft is connected to the contact pad at the second end of the shaft; and at least one guide component coupled to each contact pad to restrict movement of a corresponding contact pad to a predetermined path.

2. The tool of claim 1, wherein each shaft is rotatably-coupled at opposite ends to a corresponding linear actuator and contact pad.

3. The tool of claim 1, wherein the at least one guide component comprises at least two bow springs.

4. The tool of claim 1, wherein the at least one guide component is configured to assist with retraction of a contact pad from its anchor position even if the downhole tool loses power.

5. The tool of claim 1, wherein the at least two linear actuators comprise two linear actuators having opposite orientations that are non-perpendicular to the tool body.

6. The tool of claim 1, wherein each predetermined path corresponds to a path that is approximately perpendicular to the tool body.

7. The tool of claim 1, wherein the first anchoring device fits within an outer profile of the tool body when the contact pads are in their retracted position.

8. The tool of claim 1, wherein the linear actuator comprises a hydraulic piston.

9. The tool of claim 1, further comprising a well intervention component that is activated after the first anchoring device anchors the tool against a borehole wall or tubular.

10. The tool according to claim 1, further comprising at least one additional anchoring device to anchor the tool at different longitudinal and azimuthal positions against a borehole wall or tubular.

11. A method that comprises:

receiving, by a tool deployed in a downhole environment, an anchor instruction;

in response to receiving the anchor instruction, operating at least two linear actuators fully within and non-perpendicular to a tool body of the tool to move corresponding contact pads from a retracted position to an anchor position; and performing an operation while the tool is anchored.

12. The method of claim 11, further comprising restricting movement of each contact pad to a predetermined path.

13. The method of claim 12, wherein said restricting movement of each contact pad is performed by at least two bow springs.

14. The method of claim 12, wherein each predetermined path corresponds to a path that is approximately perpendicular to the tool body.

15. The method of claim 12, further comprising rotatably-coupling a shaft at opposite ends to a corresponding linear actuator and contact pad.

16. The method of claim 11, further comprising arranging the at least two linear actuators as two linear actuators having opposite orientations that are non-perpendicular to the tool body.

17. The method of claim 11, further comprising deploying the tool in the downhole environment using a wireline or coiled tubing.

18. The method of claim 11, wherein performing an operation while the tool is anchored comprises performing a well intervention operation.

* * * * *